United States Patent [19]
Boucher et al.
[11] 4,045,045
[45] Aug. 30, 1977

[54] FOLDABLE CHILD WALKER

[75] Inventors: Raymond W. Boucher, Dotham, Ala.; William H. Ziegler, Jr., Bedford, Pa.

[73] Assignee: Hedstrom Co., Bedford, Pa.

[21] Appl. No.: 672,655

[22] Filed: Apr. 1, 1976

[51] Int. Cl.² ..... B62D 7/10

[52] U.S. Cl. ..... 280/87.02 W; 280/87.05; 280/642; 297/5

[58] Field of Search ..... 280/87.05, 87.02 W, 280/87.02 R, 642, 643, 644, 647, 648, 649, 650; 297/5, 6

[56] References Cited

U.S. PATENT DOCUMENTS

| | | | |
|---|---|---|---|
| 2,616,718 | 11/1952 | Heideman | 280/650 |
| 2,884,046 | 4/1959 | Patrick | 280/87.05 |
| 3,145,048 | 8/1964 | Dowdy et al. | 297/5 |

FOREIGN PATENT DOCUMENTS

| | | | |
|---|---|---|---|
| 651,548 | 11/1962 | Canada | 280/87.02 W |
| 563,760 | 6/1957 | Italy | 295/5 |

*Primary Examiner*—Philip Goodman
*Assistant Examiner*—John A. Pekar
*Attorney, Agent, or Firm*—Cesari and McKenna

[57] ABSTRACT

A foldable child walker includes two inverted U-shaped frame members pivotally joined at intermediate points in a scissor-like fashion. The lower, or free, ends of the legs of the frame members are pivotally mounted to an annular base supported on a plurality of castered wheels. A flexible seat is suspended from the upper lateral portions of the frame members. Various mechanisms allow folding of the walker into a flat, compact package, convenient for storage or carrying. For example, in one embodiment, one of the two frame members has telescoping legs which are locked in selected positions of adjustment by spring-loaded release buttons to maintain the walker in selected upright positions above the base. When the walker is unoccupied, each button can be released to fold the frame members into a flat position against the base. In another embodiment, the legs in one of the two frame members are articulated below the pivotal connection the other frame member. Suitable locks are provided to maintain the legs extended in each so that the walker remains upright. To fold the walker, the locks are released allowing the legs to break so that the frame members are moved into a flat position against the base. In still another embodiment, the base is composed of two semicircular base members hinged together by knuckle joints. The knuckle joints allow the base members can be folded in only one direction, i.e. by moving the base members so that their lower surfaces face each other. Folding the base members in this manner also folds the frame members into a flat position in essentially the same plane as the folded base members. Each embodiment of the walker can be modified to serve as a bouncer.

5 Claims, 10 Drawing Figures

FOLDABLE CHILD WALKER

BACKGROUND OF THE INVENTION

This invention relates to child walkers, and more particularly, to a child walker which is of simple, sturdy and safe construction, easily folded when unoccupied into a flat, compact package for transport or storage, and easily adjusted between two or more levels to allow for use by children of different size.

A number of different types of child walkers are currently available on the market. Many walkers are foldable so as to facilitate carrying and to enable storage in areas of restricted space. Prior walkers of this type, however, often include complex release mechanisms which must be manipulated to move the walkers into a folded position. In many cases, for reasons of safety, the release mechanisms are intentionally made difficult to operate to prevent the accidental or improper collapse of the walker by a child seated therein. In one prior walker, for example, portions of the support frame must be physically detached from one another before the walker can be folded. Another prior walker includes four supporting leg members, each of which includes a separate mechanism which must be released to fold the walker. Such mechanisms are difficult to operate even when a child is not seated in the walkers. Additionally, such mechanisms are expensive to manufacture, and increase the overall cost of the walkers significantly.

Another problem often encountered with prior walkers involves adjusting the walker seat so that it is disposed at the proper level above the floor for the particular child using it. In many situations, for example, a walker is to be used by more than one child, and these children are of different sizes. Additionally, as the child grows, the optimum seal level above the floor changes. Many prior walkers include no provision for adjusting the level of the seat above the floor. In one prior walker which is adjustable, the seat is suspended from a walker frame by straps which include buckles which can be moved to engage different holes in the straps to adjust the seal level. In another prior walker, the seat includes an integral flexible flap which overlaps a lateral portion of the walker frame and is fastened to the body of the seat of snaps. Two or more rows of these snaps are included so that the seal level can be adjusted. In each of these cases, considerable time is required to adjust the level of the seat.

Accordingly, it is a general object of the invention to provide an improved child walker.

Another object of the invention is to provide a child walker which, when unoccupied, can be easily folded into a flat, compact package for transport or storage.

Another object of the invention is to provide a child walker of the type described which, though easily foldable when unoccupied, is effective in preventing accidental or improper collapse of the walker when a child is seated therein.

Yet another object is to provide a foldable walker which also functions as a bouncer.

Still another object of the invention is to provide a child walker of the type described which is easily adjustable between two or more levels above the floor to allow for use of children of different sizes.

Still another object of the invention is to provide a child walker of the type described which is lighweight and economical, yet sturdy and safe.

Other objects will in part be obvious and in part will appear hereinafter.

The invention accordingly comprises the features of construction, combination of elements, and arrangement of parts which will be exemplified in the following detailed description, and the scope of the invention will be indicated in the appended claims.

Briefly, a foldable child walker embodying the invention includes two inverted U-shaped frame members pivotally joined at intermediate points in a scissor-like fashion. The lower, or free, ends of the legs of the frame members are pivotally mounted to an annular base. A flexible seat is suspended from the upper lateral portions of the frame members. The base has a relatively large diameter and is supported on a plurality of swivel casters. The large diameter base provides stability and resists tipping, while swivel casters allow easy movement of the walker in all directions by a child seated therein.

In one embodiment of the invention, one of the two frame members has telescoping legs which are locked in selected positions of adjustment by spring-loaded release buttons to maintain the walker in selected upright positions above the base. When a child is seated in the walker, the weight of the child resists release of the buttons and thus minimizes the likelihood of an accidental or improper collapse of the walker. When the walker is unoccupied, however, the frame members can be easily folded into a flat position against the base by releasing each button and moving the frame members towards the base.

In a second embodiment of the invention, the legs of one of the two frame members are articulated below the pivotal connection to the other frame member. suitable locks are provided to maintain the legs extended so that the walker remains upright. To fold the walker, the locks are released allowing the legs to break so that the frame members are moved into a flat position against the base.

In a third embodiment, the base is composed of two semicircular base members hinged together by knuckle joints. These joints allow the base members to be folded such that their lower surfaces face each other, but prevent folding in the opposite direction. Folding the base members in this manner causes the frame members to fold in a scissor-like fashion into a flat position in essentially the same place as the folded base members.

Each embodiment of the invention can be modified to serve as a bouncer. For this purpose, one of the frame members is made with telescoping legs. Coil springs inside the two legs bias the leg sections to impart resiliency to the walker frame relative to its base.

BRIEF DESCRIPTION OF THE DRAWINGS

The foregoing and other features and advantages of the invention will be better understood from the following detailed description taken in conjunction with the accompanying drawings in which:

FIG. 5, comprising

DETAILED DESCRIPTION

Figure 1:
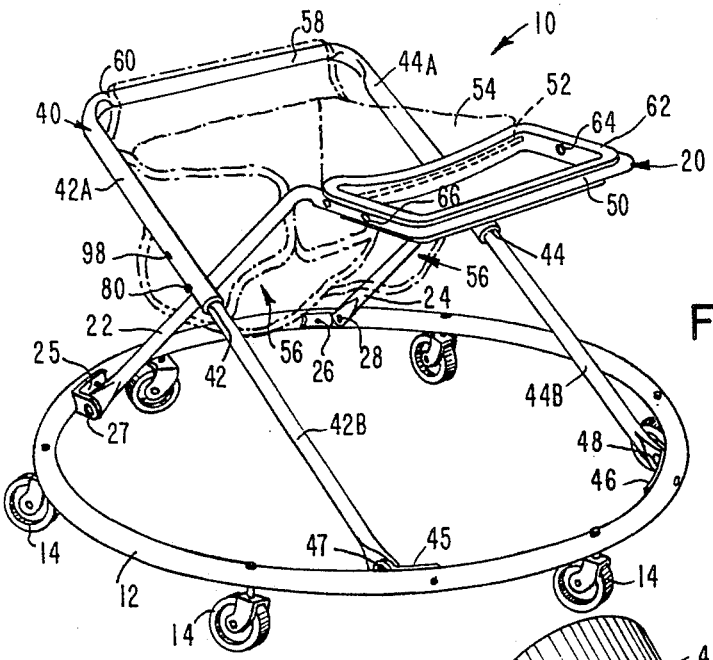
FIG. 1 is a perspective view of a first embodiment of the walker of the invention.

Referring now to FIG. 1, there is shown a walker 10 embodying the invention including an annular base 12 mounted on a plurality of castered wheels 14. Each castered wheel 14 includes an upwardly projecting shaft 16 (FIG. 4) rotatively mounted in a socket 18 in the base 12. The base may be of a lightweight metal tubular construction and preferably has a diameter of about two feet. The annular base 12 and plurality of castered wheels 14 allow easy movement of the walker 10 in any direction and prevent tipping of the walker 10 when a child is seated therein. A resilient bumper (not shown) may be mounted to the outer peripheral surface of the base 12 to prevent damage to furniture, walls, etc.

A child supporting frame comprises a pair of intersecting inverted U-shaped frame members indicated generally by 20 and 40. The frame member 20 includes a pair of legs 22 and 24. The lower, or free, ends of the legs 22 and 24 are pivotally mounted to the rear portion of the base 12 by means of mounting brackets 25 and 26 and pivots 27 and 28. The brackets 25 and 26 are suitably secured to the inside surface of the base 12, e.g. by welding or riveting. The lower ends of the legs 22 and 24 are flattened and provided with a hole which is aligned with a corresponding hole in the bracket 25 and 26, respectively. The pivots 27 and 28, each of which may comprise a bolt and nut, or rivet are inserted and fixed in these aligned holes to support the legs 22 and 24 relative to the base 12, but to allow pivotal movement of the legs relative to the brackets 25 and 26.

The frame member 40 also includes a pair of legs 42 and 44, the lower ends of the legs 42 and 44 are pivotally mounted to the front portion of the base 12 as described above using mounting brackets 45 and 46 and pivots 47 and 48. The lateral spacing between the legs 42 and 44 in the frame member 40 is slightly larger than that between legs 22 and 24 in the frame member 20. The The frame member 20 thus fits within the frame member 40, as indicated in FIG. 1.

An upper portion 50 of the frame member 20 is inclined relative to its lower portion so as to be essentially parallel to the base 12 when the walker is in an upright or open position. A bar 52 bridges the leg 22 and 24 of the frame member 20 along the rear edge of the upper portion 50. The ends of the bar 52 are friction fitted in respective holes provided in the inside wall of the legs 22 and 24. A flexible bag seat 54 including leg openings 56 and backpad 58 is suspended from the bar 52 and from the upper lateral portion 60 of the frame member 40. The seat 54 includes forward and rear integral flaps which are folded over the bar 56 and the lateral portion 60, respectively, and secured to the body of the seat 54 by stitching, snaps or other means (not shown). A plastic tray 62 is fixed to the upper portion 50 of the frame member 20 using rivets 64 and 66 which engage respective holes in the legs 22 and 24. The tray 62 provides a suitable surface for playthings or for feeding a child.

As indicated in FIG. 1, the frame member 40 is of a twopart tubular construction. Specifically, the legs 42 and 44 include upper leg parts 42A and 44A and lower leg parts 42B and 44B. The upper leg parts 42A and 44A form an integral unit with the lateral portion 60 of the frame member 40. The upper leg parts 42A and 44A are also pivotally connected to the leg 22 and 24, respectively, of the frame member 20 in a manner which can be better appreciated from the enlarged view of FIG. 2.

Figure 2:
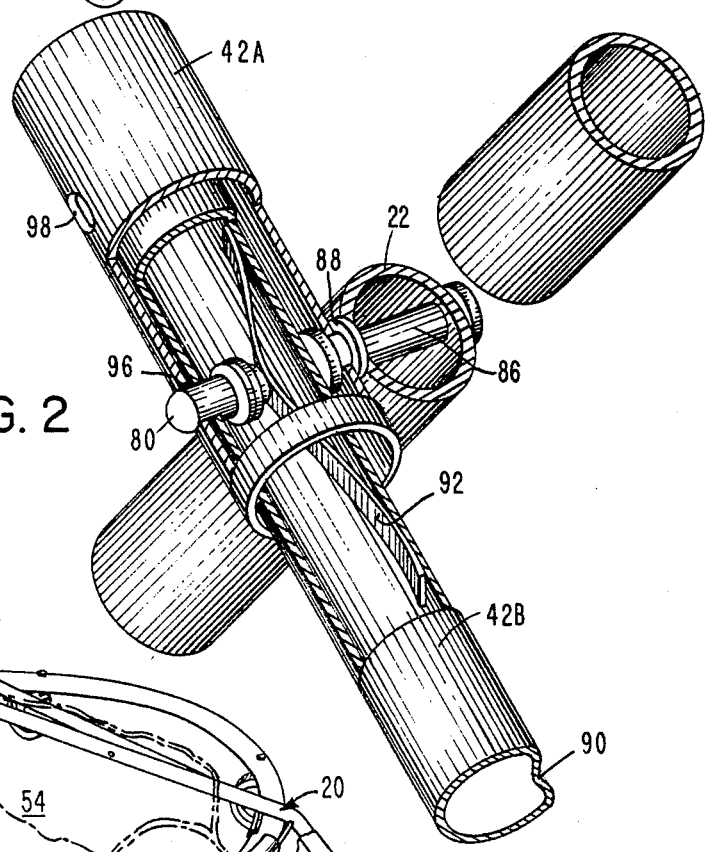
FIG. 2 is an enlarged perspective view, partly cut away, showing further details of the walker of FIG. 1.

As seen in FIG. 2, the upper leg part 42A of the frame member 40 is pivotally joined to the leg 22 of the frame member 20 by a pivot pin 86. The pin 86 includes a head which contacts the inside surface of the leg part 42A and a shaft which extends completely through the leg 22. The end of the pin 86 extending out of the leg 22 is flattened against the outside surface of the leg 22 to fix the pin in position. A washer 88 is disposed between the leg part 42A and leg 22 to facilitate relative motion therebetween.

The lower leg part 42B is dimensioned to fit inside of the upper leg part 42A. Preferably, the lower leg part 42B is flattened at 90 so that the head of the pivot pin 86 is cleared when the leg 42B moves inside of the leg part 42A. A push button 80 projects radially from the leg part 42B. The push button 80 is maintained in a normally extended position by a leaf spring 92 attached to the inside wall of the leg part 42B.

As indicated in FIG. 2, the push button 80 engages in an aperture 96 cut through the wall of the leg part 42A. The button thus holds the upper leg part 42A stationary relative to the lower leg part 42B. A push button 80 and release mechanism identical to that shown in FIG. 2 and is provided for the legs 24 and 44 on the opposite side of the walker 10 obscured from view in FIG. 1.

Figure 3:
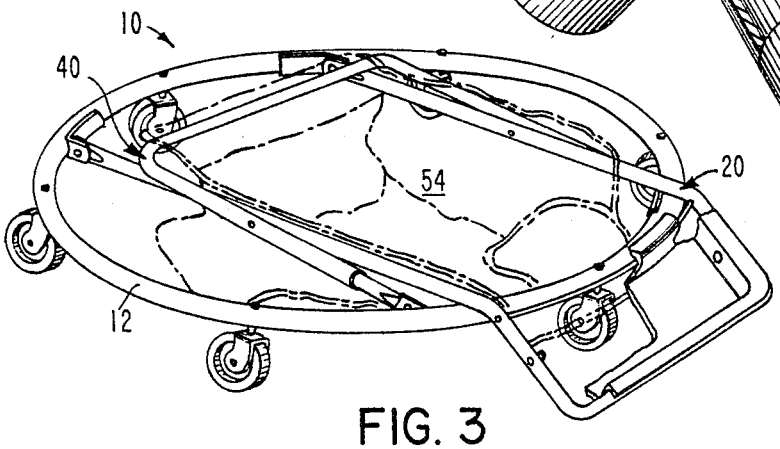
FIG. 3 is a perspective view of the walker of FIG. 1 in a folded position.

The walker 10 is thus maintained in an upright position when the buttons 80 on each side thereof are made to engage in the corresponding apertures 96 in the upper leg parts 42A and 44A. Folding of the walker 10 is accomplished by first depressing the buttons 80. This frees the lower leg parts 42B and 44B to move telescopically inside the upper leg parts 42A and 44A. The frame members 20 and 40 can thus be pivoted relative to one another in a scissor-like fashion about the pivot pins 86 and moved toward the base 12. FIG. 3 illustrates the walker 10 in its fully folded position. As can be appreciated from FIGS. 3, the walker 10 is foldable into a flat, compact package which is convenient for carrying or for storage.

Unfolding of the walker 10 is accomplished simply by moving the frame members 20 and 40 away from the base 12. When the proper level of the frame members 20 and 40 above the base 12 is reached, the push buttons 80, because of the action of the springs 92, automatically engage the apertures 96 and lock the walker 10 in an upright position.

When a child is seated in the walker 10, the weight of the child causes the upper edge of each aperture 96 to press against the upper surface of its increased button 80. The advantageously provides an increased resistance to the inadvertant depression of the buttons 80 by the child, and greatly decreases the likelihood of an accidental or improper collapse of the walker 10 when a child is seated therein.

Additionally, as indicated in the FIGS. 1 and 2, each of the upper leg parts 42A and 44A preferably include a second aperture 98. By allowing the buttons 80 to engage the apertures 98 instead of the apertures 96, the level of the seat 54 above the base 12 is decreased. The walker 10 can thus be adapted readily to children of different sizes. Clearly, several such aperture pairs can be spaced along the leg parts 42A and 44A to provide several different levels of adjustment, if desired.

Figure 4:
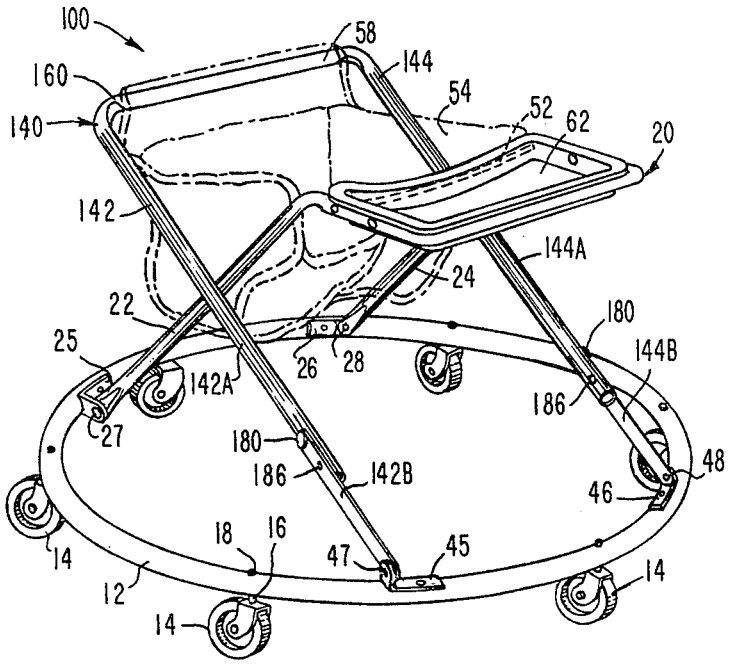
FIG. 4 is a perspective view of a second embodiment of the the walker of invention.
Figure 5A:
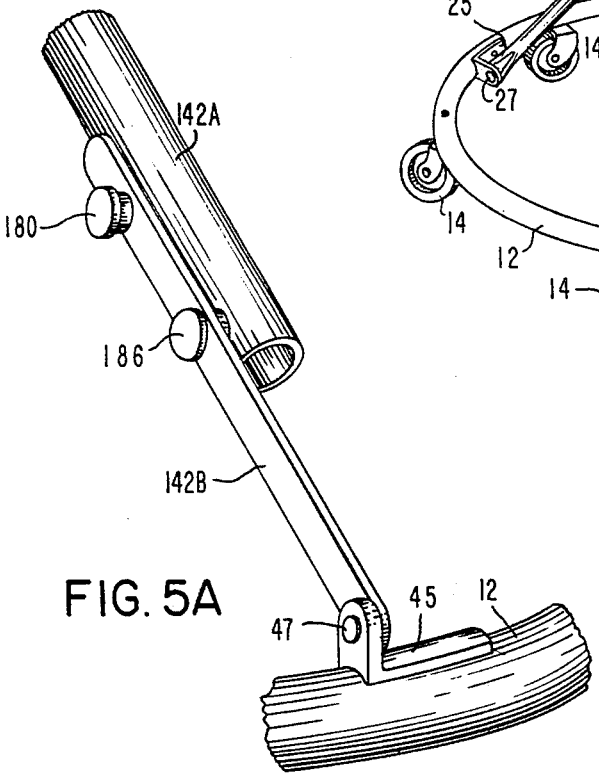
FIGS. 5A and 5B, are enlarged views showing further details of the walker of FIG. 4.
Figure 5B:
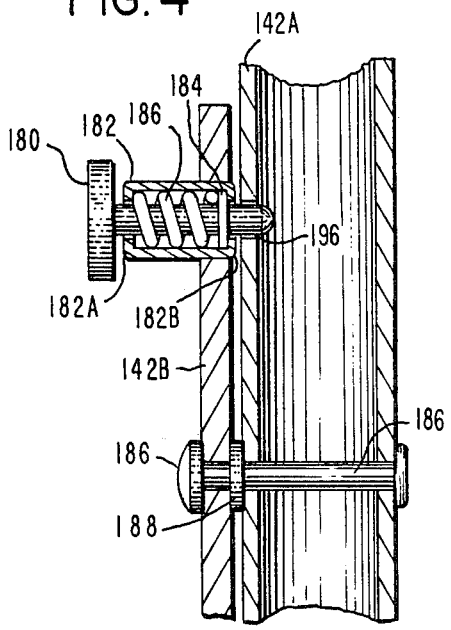
Figure 6:
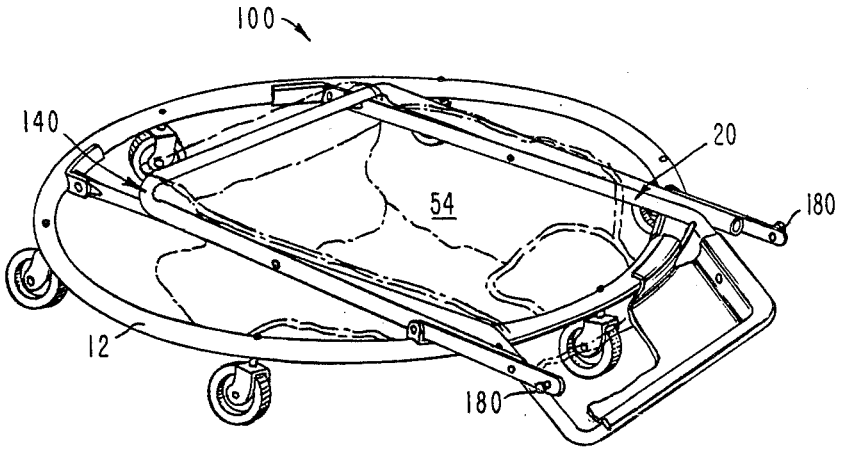
FIG. 6 is a perspective view of the walker of FIG. 4 in a folded position.

FIGS. 4, 5 and 6 illustrate another walker embodying the invention and incorporating a modified folding mechanism. The walker 100 illustratively includes many of the same components of the walker 10 shown in FIGS. 1, 2 and 3 and described above. These components are designated by the same reference characters in FIGs. 4, 5 and 6. As the common components have been described in detail above, the discussion below will be limited to those portions of the walker 100 which differ from the walker 10.

Walker 100 includes an inverted U-shaped frame member 140 including legs 142 and 144 which, with the frame member 20, constitute a child-supporting frame. Each of the legs 142 and 144 is of a two-part construction including upper leg parts 142A and 144A and lower leg parts 142B and 144B. The upper leg parts 142A and 144A are constructed of metal tubing, while the lower leg parts 142B and 144B are flattened strips of metal. The upper leg parts 142A and 144A form a integral U-shaped unit with an upper lateral portion 160 of the frame member 140. The portion 160 supports the rear of the child seat 54 and is dimensioned so that the upper leg parts 142A and 144A fit within the legs 22 and 24 of the frame member 20. The upper leg parts 142A and 144A are pivotally connected to the legs 22 and 24, respectively, by pivot pins (not shown) like pivot pins 86 of FIGS. 1 to 3. This allows relative pivotal motion of the frame members 140 and 20.

FIG. 5 is an enlarged view of the leg 142 of the frame member 140, which better illustrates the modified folding mechanism of the walker 100. As seen in FIG. 5A, the lower end of the leg part 142B is pivotally mounted to the front portion of the base 12 by means of mounting bracket 45 and pivot 47. The leg part 142B is also pivotally mounted to the lower end of the leg part 142A by a pivot pin 186. The pivot pin 186 is illustratively identical to the pins 86 used to interconnect the frame members 20 and 140. A washer 188 is interposed between the leg parts 142A and 142B.

As indicated in FIG. 5A, and as best seen in FIG. 5B, a pull button 180 is attached to the upper end of the leg part 142B. The button 189 is carried within a sleeve 182 which is suitably press-fit into the leg part 142B. A washer 184 is fixed to the shaft of the button inside of the sleeve 182. The washer 184 has an outer diameter slightly less than the inside diameter of the sleeve 182. The opposed open ends 182A and 182B of the sleeve 182 are bent to reduce the area of the openings in the sleeve to a size slightly larger than the cross-sectional area of the shaft of button 180. A coil spring 186 is disposed inside the sleeve 182 about the shaft between the sleeve end 182A and the washer 184. The spring 186 maintains the button 180 in a position normally extending from the leg part 142B (i.e. to the left in FIG. 5B). As indicated in FIG. 5B, the left end of the button 180 engages in an aperture 196 in the wall of the leg part 142A. With the button 180 in its normally extended position engaging the aperture 196, the leg 142A and 142B are maintained stationary relative to each other. A folding mechanism identical to that shown in FIGS. 5A and 5B is provided for the leg parts 144A and 144B of the opposite side of the walker 100 obscured from view in FIG. 4.

The walker 100 is folded by pulling the buttons 180 to disengage their shafts from the apertures 196 in the leg parts 142A and 144A, respectively. This allows the lower leg parts 142B and 144B to break relative to the upper leg part 142A and 144A about the pivot pins 186. The lower leg parts 142B and 144B can thus be pivoted toward the front of the walker 100, allowing the frame members 20 and 140 to be collapsed toward the base 12. FIG. 6 illustrates the walker 100 in a fully folded position. As can be appreciated from FIG. 6, the walker 100 folds into a flat, compact package against the base 12.

The walker 100 is unfolded simply by moving the frame 20 and 140 away from the base 12. As the buttons 180 shafts engage the wall of the leg parts 142A and 144A, each is forced to move outwardly against the action of the spring 186. When the apertures 196 in leg parts 142A and 144A are reached, the springs 186 automatically force the shafts into the apertures 196. The walker 100 thus automatically locks in an upright position.

It will be noted that when a child is seated in walker 100, the weight of the child provides an increased resistance to the release of the release buttons 180. Thus, like the walker 10 above, the walker 100 is effective in decreasing the likelihood of an improper or accidental collapse of the walker when a child is seated therein. When the walker 100 is unoccupied, however, the pull buttons 180 are easily operated.

Figure 7:
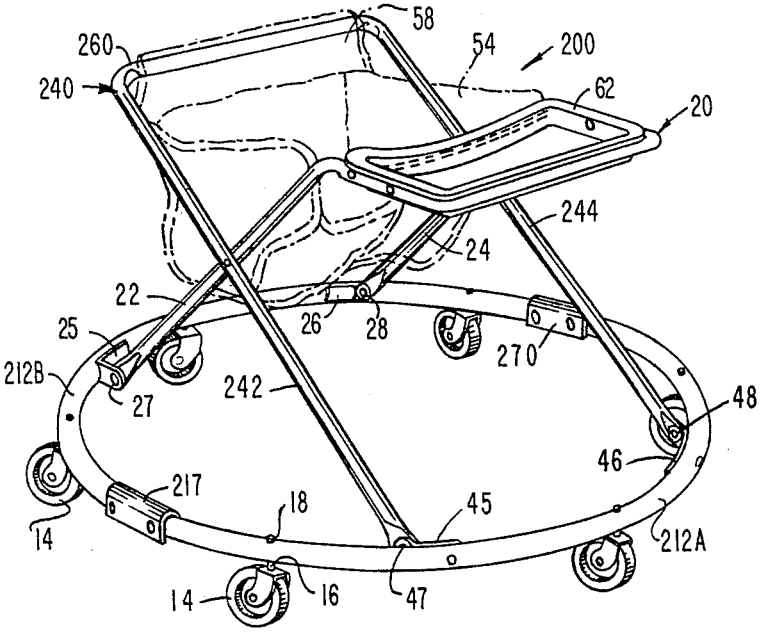
FIG. 7 is a perspective view of a third embodiment of the walker of the invention.
Figure 8:
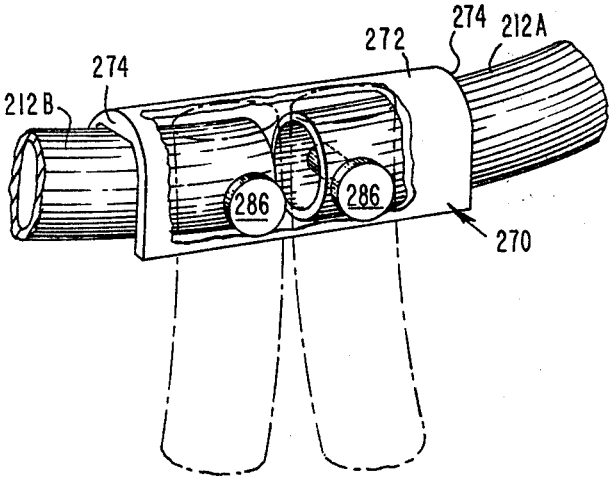
FIG. 8 is an enlarged perspective view, partly cut away, showing further details of the walker of FIG. 7.
Figure 9:
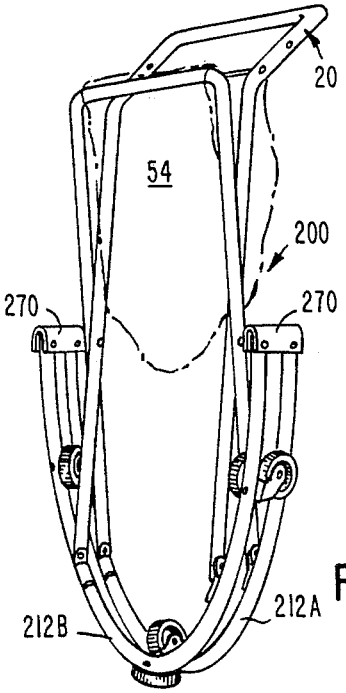
FIG. 9 is a perspective view of the walker of FIG. 7 in a folded position.

FIGS. 7, 8 and 9 illustrate still another walker 200 embodying the invention and incorporating another modified folding mechanism. Again, many of the components of the walker 200 are incidental to those of the walker 10 described above. These components are thus referenced by the same numerals in FIGS. 7 through 9. The walker 200 includes an inverted U-shaped frame member 240 which with the frame member 20 forms a child supporting frame. The frame member 240 has an integral U-shaped tubular construction including one-piece legs 242 and 244 and an upper lateral portion 260. The lower ends of the legs 242 and 244 pivotally mounted to the front portion of an annular base 212 by mounting brackets 45 and 46 and pivots 47 and 48, respectively. The legs 242 and 244 are also pivotally connected at an intermediate point to the legs 22 and 24, respectively, of the frame member 20 by pivots (not shown in FIGS. 7 through 9) like pivots 66 in FIGS. 1 to 3 above.

The annular base 212 of the walker 200 is composed of two semicircular base members 212A and 212B. The free ends of these members at the sides of the walker are interconnected by knuckle joints 270. One of these joints 270 is shown in more detail in FIG. 8 of the drawing.

As seen in FIG. 8, the joint 270 comprises a sleeve 272, typically of metal, open at both ends and along the bottom. The sleeve 272 has inside dimensions larger than the outside dimensions of the base members 212A and 212B. The free ends of the base members 212A and 212B extend into opposite ends of the sleeve 272 and are pivotally connected to the sleeve by pivots 286. Sufficient clearance is maintained in the upper inside portion of the sleeve 272 to permit the base members 212A and 212B to be pivoted into the position indicated by the dotted outline in FIG. 8. An integral lip 274 may project downwardly from each end of the sleeve 272 to prevent excessive pivotal motion of the base members 212A and 212B in the opposite direction. The lips 274 assist in maintaining the base members 212A and 212B in a common horizontal plane when the walker 200 is in use.

When unoccupied, the walker 200 is folded simply by folding the base members 212A and 212B toward each other as indicated in FIG. 9. This also causes the frame members 20 and 240 to pivot toward each other in a scissor-like fashion and to fold in essentially the same place as the folded base members 212A and 212B. The walker 200 is unfolded by moving the base members 212A and 212B away from each other and into the same horizontal place as shown in FIG. 7.

Figure 10:
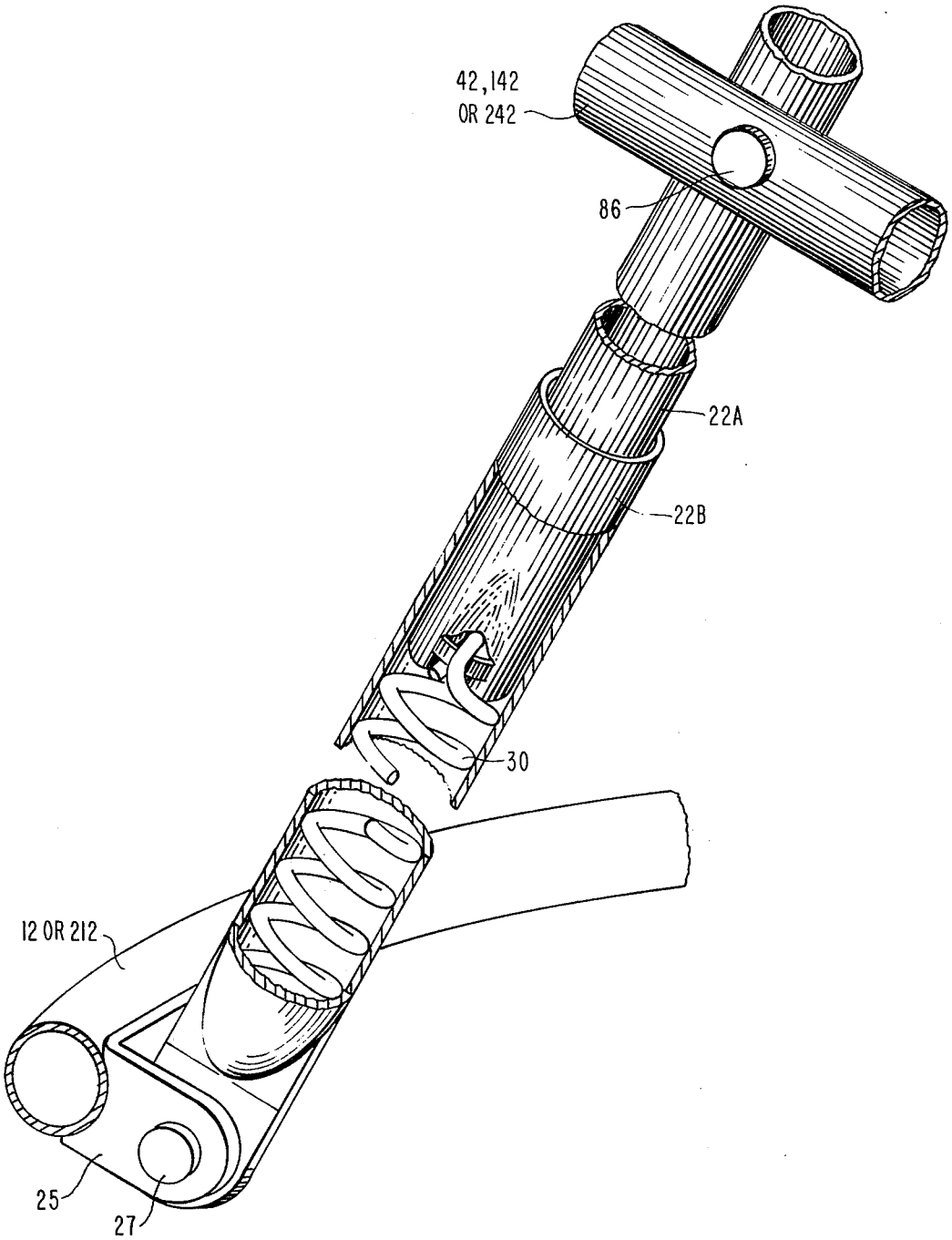
FIG. 10 is an enlarged perspective view, partly cut away, showing a bouncer modification for the walkers of FIGS. 1, 4 and 7.

As noted, each of the above walkers 10, 100 and 200 can be converted into a walker-bouncer. The conversion is illustratively accomplished by a relatively simple modification of the legs 22 and 24 of the frame member 20 in each walker. The modification is illustrated in FIG. 10 for the leg 22 of the frame member 20. An identical modification is made to the leg 24.

As indicated in FIG. 10, the leg 22 of the frame member 20 is cut a suitable distance below the pivot pin 86 and short of the base 12 to form an upper leg part 22A. A lower leg part 22B having an inside diameter slightly larger than the outside diameter of the upper leg part 22A is added. The lower end of the lower leg part 22B is flattened and pivotally mounted to the real portion of the annular base 12 or 212 in the manner described above using mounting bracket 25 and pivot 27. The upper leg part 22A is inserted in the opposite end of the lower leg part 22B. A relatively heavy coil spring is attached to the lower end of the leg part 22A. The spring 30 may, for example, be attached to the leg part 22A by bending one or more coils of the spring through a hole provided through the wall of the leg part 22A, as indicated in FIG. 10. The end of the coil spring 30 opposite to that attached to the leg part 22A presses against the flattened inside surface of the lower leg part 22A.

A child seated in the walker 10, 100 or 200 modified as indicated in FIG. 10 can thus bounce up and down in the seat 54 to cause movement of the walker frame relative to the base 12 or 212 against the resiliency of the springs 30. The overlap between the upper leg part 22A and the lower leg part 22B is made sufficiently large to prevent the leg parts from separating during bouncing.

Of course, each unit can be converted to a bouncer only simply by removing the casters 14. Additionally, rather than using the internal spring mechanism illustrated in FIG. 10, a similar bouncing effect can be imparted to the walkers by fastening the free ends of the legs 22 and 24 to the annular base with an exposed spring mechanism.

In summary, therefore, I have disclosed various embodiments of a lightweight, yet sturdy child walker each of which easily folds into a flat compact package for transport or storage. The folding mechanism in each embodiment is easy to operate when the walker is unoccupied, yet effective in preventing accidental or improper collapse of the walker when a child is seated therein. Each embodiment of the walker is simple in construction and thus economical to manufacture. The large diameter annular base and plurality of swivel casters in each case allow easy movement of the walkers, and prevent tipping. In one embodiment of the walker, the level of the seat above the base is easily adjusted to allow use of children of different sizes or for the growth of an individual child.

It should be understood that the above described embodiments are intended to illustrate, but not limit, the invention. Numerous variations and modifications of these embodiments will be recognized as possible by those skilled in the art without departing from the scope of the invention, and defined by the appended claims.

What I claim as new and desire to secure by Letters Patent of the United States is:

1. A child walker comprising
   A. an annular base,
   B. a plurality of wheels mounted at space locations on said base,
   C. a supporting frame including
      1. first and second interfitting frame members, each said member including a pair of legs,
      2. means for pivotally connecting each leg of said first member to an adjacent leg of said second member intermediate the ends of the legs,
      3. means for pivotally mounting corresponding ends of said first and second frame members to spaced positions on said base, and
      4. the legs of at least one of said frame members being composed of telescoping first and second sections,
   D. a seat supported between the opposite ends of the legs of said first and second frame members,
   E. means for maintaining said first and second frame members upright above said base, said maintaining means including
      1. means for defining at least two spaced apertures extending through the wall of one of said upper and lower leg sections, and
      2. a spring loaded release button mounted in the wall of the other of said upper and lower leg sections and positioned to selectively engage in one of said apertures so that the frame members are maintainable at at least two different levels above said base, said button being retractable from one aperture to release the maintaining means and fold the walker so that the frame members fold into a relatively flat position in more or less the same plane as said base.

2. The walker defined in claim 1 and further including means for resiliently supporting the seat on said base.

3. The walker defined in claim 2 wherein
   A. the legs of the other frame member are composed of telescoping first and second sections, and
   B. the resilient supporting means includes means for biasing said first and second leg sections toward their extended positions.

4. The walker defined in claim 1 and further including
   A. a tray, and
   B. means for mounting the tray on one of said frame members adjacent to said seat.

5. A child walker as recited in claim 1
   A. in which each of the legs of the other frame member is composed of telescoping upper and lower sections, and
   B. further including means for biasing the upper and lower sections of each leg away from one another whereby a bouncing movement may be imparted to said seat means relative to said base.

* * * * *